US005702018A

United States Patent [19]

Montgomery

[11] Patent Number: 5,702,018

[45] Date of Patent: Dec. 30, 1997

[54] POSITIVE SEAL FERMENTATION LOCK FOR WINE BARRELS

[76] Inventor: Donald C. Montgomery, 1250 Enos Ave., Sebastopol, Calif. 95472

[21] Appl. No.: 552,103

[22] Filed: Nov. 2, 1995

[51] Int. Cl.[6] ..... B65D 51/16

[52] U.S. Cl. ..... 220/203.13; 220/203.27; 220/203.29; 215/311; 215/364; 137/854; 217/100

[58] Field of Search ..... 215/358, 361, 215/364, 270, 271, 262, 260, 307, 311; 217/78, 79, 99, 108, 109; 220/203.11, 203.13, 203.27, 203.29, 231, 89.1, 367.1, 373, 203.19, 203.2, 203.23; 137/854, 852

[56] References Cited

U.S. PATENT DOCUMENTS

| | | | |
|---|---|---|---|
| 583,972 | 6/1897 | Beavis | 215/270 X |
| 934,103 | 9/1909 | Stauton | 215/260 |
| 1,653,818 | 12/1927 | Nagel | 217/100 |
| 2,224,296 | 12/1940 | Hoffman | 220/231 X |
| 2,571,893 | 10/1951 | Kendall | 220/203.13 X |
| 2,603,218 | 7/1952 | Rane | 215/260 X |
| 2,769,457 | 11/1956 | Wittenberg | 220/203.13 X |
| 3,454,182 | 7/1969 | Morton | 137/854 X |
| 3,487,728 | 1/1970 | Perry et al. | 137/854 |
| 3,805,990 | 4/1974 | Palaudarias | 220/231 X |
| 3,811,650 | 5/1974 | Dehar | 220/231 X |
| 4,658,979 | 4/1987 | Mietz et al. | 220/203.13 |
| 5,339,981 | 8/1994 | Kral | 220/367.1 X |

FOREIGN PATENT DOCUMENTS

| | | | |
|---|---|---|---|
| 524551 | 1/1993 | European Pat. Off. | 220/231 |
| 276896 | 10/1964 | Netherlands | 220/231 |
| 443557 | 3/1936 | United Kingdom | 220/231 |
| 662889 | 12/1951 | United Kingdom | 220/203.13 |

*Primary Examiner*—Allan N. Shoap
*Assistant Examiner*—Nathan Newhouse
*Attorney, Agent, or Firm*—Larry D. Johnson

[57] ABSTRACT

A stopper apparatus for use with wine barrel bung holes includes a generally frusto-conical stopper member having a central aperture, a top surface, a bottom surface, and an outer circumferential surface adapted to seal against the inner circumferential surface of the bung hole. The apparatus further includes a sealing insert member having a top portion, a middle portion, and a bottom portion, the top portion having a diameter greater than the stopper member central aperture, and which has a lower surface adapted for sealing engagement against the stopper member top surface. The bottom portion includes at least one flexible lateral projection element adapted to contact and apply a force against the stopper member bottom surface, so as to urge the top portion lower surface into sealing engagement with the stopper member top surface.

2 Claims, 1 Drawing Sheet

POSITIVE SEAL FERMENTATION LOCK FOR WINE BARRELS

BACKGROUND OF THE INVENTION

1. Field of the Invention

This invention relates generally to stoppers and seals used for access and vent holes in a container, and more specifically to an improved stopper apparatus for use with wine barrels and the like, providing a positive seal fermentation lock for the barrel.

2. Description of the Prior Art

Wine barrels and related containers typically include a bung hole or vent hole in a side or end of the barrel, through which the barrel can be filled or emptied, and the contents of the barrel accessed for topping off, testing, sampling, treatment and the like. The bung hole is usually sealed with a frusto-conically shaped stopper member to prevent contaminants from entering the barrel, and to prevent air circulation into or out of the barrel. These stopper members are often made from wood, rubber, silicone, or like material, and are well known and in widespread use.

Carbon dioxide and/or other asses may be produced as a byproduct of the wine fermentation process. These gasses may accumulate in the barrel until the gas pressure exceeds the sealing pressure provided by the stopper, at which time the stopper is displaced and the gas escapes. Often, displacement of the stopper is a minor matter and of little consequence, such that the stopper continues to provide a zero-pressure seal. However, on other occasions the displacement may be significant, resulting in a complete loss of sealing.

SUMMARY OF THE INVENTION

The positive seal fermentation lock for wine barrels of this invention provides a stopper apparatus for use with wine barrel bung holes, or vent holes in any vessel. The apparatus includes a generally frusto-conical stopper member having a top surface, a bottom surface, and an outer circumferential surface which is adapted to seal against the inner circumferential surface of a barrel's bung (vent) hole, all in the traditional manner. The stopper member includes a central aperture having a length and a diameter, preferably along the longitudinal axis of the stopper member.

The apparatus further includes a sealing insert member having a top portion, a middle portion, and a bottom portion, with the top portion having a diameter greater than the stopper member central aperture, and which has a lower surface adapted for sealing engagement against the stopper member top surface. In the preferred embodiment, the top portion lower sealing surface is conical in shape to provide an efficient sealing geometry with the stopper member (preferably flat) top surface. The sealing insert member middle portion has a length generally equal to the stopper member central aperture, and a diameter less than the stopper member central aperture, and is thus adapted for passage therethrough. The sealing insert member terminates in a bottom portion which includes at least one, and preferably two or more preferably opposed flexible lateral projection elements adapted to contact and apply a force against the stopper member bottom surface, so as to urge the top portion lower surface into sealing engagement with the stopper member top surface.

This arrangement thus seals the bung or vent hole to provide a positive seal against air or any other matter entering the barrel. When gases form inside the vessel or wine barrel, the resultant pressure will exert a force against the insert member top portion lower sealing surface, and flex the lateral projection elements, breaking the seal formed between the insert member top portion lower sealing surface and the stopper member top surface, thus allowing the gas to escape. The amount of pressure required to operate this one-way valve can be adjusted by appropriate selection of the size and position of the lateral projection elements, or by changing the properties of the materials used.

DETAILED DESCRIPTION OF A PREFERRED EMBODIMENT

Figure 1:
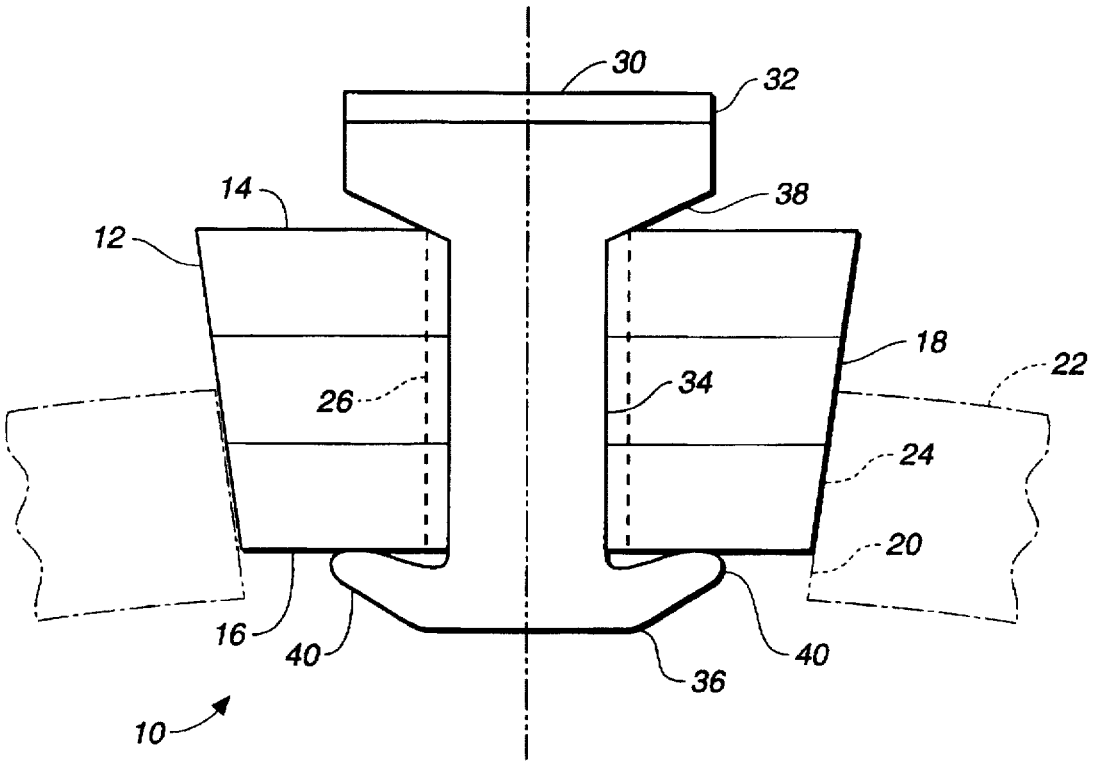
FIG. 1 is a side elevation cross-sectional view of a positive seal fermentation lock for wine barrels of this invention, illustrating a generally frusto-conical stopper member having a top surface, a bottom surface, and an outer circumferential surface adapted to seal against the inner circumferential surface of a wine barrel's bung hole, the stopper member including a central aperture; and a sealing insert member having a top portion, a middle portion, and a bottom portion, the top portion having a lower surface adapted for sealing engagement against the stopper member top surface, the bottom portion including two opposed flexible lateral projection elements adapted to contact and apply a force against the stopper member bottom surfaces

FIG. 1 is a side elevation cross-sectional view of a positive seal fermentation lock 10 for wine barrels of this invention, illustrating a generally frusto-conical stopper member 12 having a top surface 14, a bottom surface 16, and an outer circumferential surface 18 adapted to seal against the inner circumferential surface 20 of a wine barrel 22 bung hole 24. The stopper member may be made of rubber, silicone, or other suitable material, and have approximate dimensions of 2.20 inches diameter at the top surface, 1.85 inches diameter at the bottom surface, and 1.0 inches in height. The stopper member includes a central aperture 26 which may be of approximately 11/16 inches in diameter. Sealing insert member 30 has a top portion 32, a middle portion 34, and a bottom portion 36. The top portion 32 has a lower surface 38 adapted for sealing engagement against the stopper member top surface 14. In the preferred embodiment, this lower surface 38 is frusto-conical in shape. The bottom portion 36 includes two opposed flexible lateral projection elements 40 adapted to contact and apply a force against the stopper member bottom surface 16.

Figure 2:
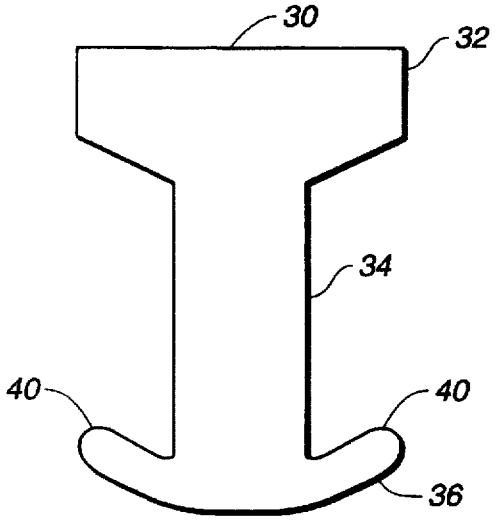
FIG. 2 is a front elevation view of the sealing insert member of FIG. 1.

FIG. 2 is a front elevation view of the sealing insert member 30 of FIG. 1. This view illustrates top portion 32, middle portion 34, and bottom portion 36, with its lateral projection elements 40. The sealing insert member 30 may be made of thirty-five "A" durometer FDA silicone rubber, or other elastomer compounds, or other suitable materials. Overall dimensions for the sealing insert member may be 1.75 inches in height, 1.25 inches in diameter at the top and in width at the lateral projection elements, and 0.50 inches in diameter at the middle portion.

Figure 3:
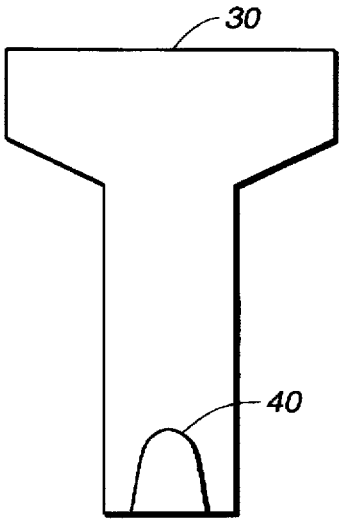
FIG. 3 is a side elevation view of the sealing insert member of FIG. 1.

FIG. 3 is a side elevation view of the sealing insert member 30 of FIG. 1. This view serves to illustrate that the lateral projection elements 40 may be generally narrower than the insert member middle portion (e.g., 0.25 inches wide), and may be in the form of exactly one pair of opposed elements. This arrangement may be desirable to enable insertion of the insert member into the stopper member upon assembly of the apparatus, as well as removal of the insert member from the stopper member (when necessary), by forcibly bending or otherwise distorting the projection elements to enable their passage through the stopper member central aperture.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. A positive seal fermentation lock apparatus for a barrel having a bung hole, said bung hole having an inner circumferential surface, said apparatus comprising:

a generally frusto-conical stopper member having a top surface, a bottom surface, and an outer circumferential surface for sealing against the inner circumferential surface of said barrel's bung hole, said stopper member including a central aperture having a length and a diameters; and a sealing insert member having a top portion, a middle portion, and a bottom portion, said top portion having a diameter greater than said stopper member central aperture diameter, said top portion having a lower surface for sealing against said stopper member top surface, said middle portion having a length generally equal to said stopper member central aperture length, and a diameter less than said stopper member central aperture diameter, said bottom portion including two flexible lateral projection elements to contact and apply a force against said stopper member bottom surface, so as to urge said top portion lower surface into sealing engagement with said stopper member top surface, wherein when gases form inside the barrel, the resultant pressure will exert a force against said insert member top portion lower sealing surface, and flex said lateral projection elements, breaking the seal formed between said insert member top portion lower sealing surface and said stopper member top surface, allowing the gases to escape.

2. The apparatus of claim 1 wherein said sealing insert member top portion lower surface is frusto-conical in shape.

* * * * *